US006163018A

United States Patent [19]

Fukumoto et al.

[11] Patent Number: 6,163,018

[45] Date of Patent: Dec. 19, 2000

[54] LINE-TYPE HEATER

[75] Inventors: Hiroshi Fukumoto; Teruhisa Sako; Tokihiko Kishimoto, all of Kyoto, Japan

[73] Assignee: Rohm Co., Ltd., Kyoto, Japan

[21] Appl. No.: 09/326,692

[22] Filed: Jun. 7, 1999

[30] Foreign Application Priority Data

Jun. 9, 1998 [JP] Japan ..... 10-160803

[51] Int. Cl.[7] ..... H05B 3/02

[52] U.S. Cl. ..... 219/546; 219/543; 338/311

[58] Field of Search ..... 219/209, 216, 219/469, 535, 543, 544, 546, 548, 553; 338/311

[56] References Cited

U.S. PATENT DOCUMENTS

| | | | |
|---|---|---|---|
| 3,432,792 | 3/1969 | Hatcher, Jr. | 338/311 |
| 4,034,189 | 7/1977 | Sakamaki et al. | 219/543 |
| 4,035,613 | 7/1977 | Sagawa et al. | 219/543 |
| 4,136,611 | 1/1979 | Watanabe et al. | 219/546 |
| 4,203,197 | 5/1980 | Crandell | 338/311 |
| 4,204,187 | 5/1980 | Kakuhashi et al. | 338/311 |
| 4,575,619 | 3/1986 | Porzky | 219/546 |
| 4,697,165 | 9/1987 | Ishiguro et al. | 219/543 |
| 4,733,056 | 3/1988 | Kojima et al. | 219/543 |
| 5,068,517 | 11/1991 | Tsuyuki et al. | 219/543 |
| 5,162,634 | 11/1992 | Kusaka et al. | 219/216 |
| 5,587,097 | 12/1996 | Sato et al. | 219/543 |
| 5,822,675 | 10/1998 | Paquet et al. | 219/543 |
| 5,965,049 | 10/1999 | Carlet | 219/543 |

FOREIGN PATENT DOCUMENTS

| | | |
|---|---|---|
| 7-147180 | 6/1995 | Japan . |
| 8-305190 | 11/1996 | Japan . |
| 9-35852 | 2/1997 | Japan . |
| 10-282819 | 10/1998 | Japan . |
| 10-301419 | 11/1998 | Japan . |

*Primary Examiner*—Teresa Walberg
*Assistant Examiner*—Fadi H. Dahbour
*Attorney, Agent, or Firm*—Morgan, Lewis & Bockius LLP

[57] ABSTRACT

A recess portion is provided in a portion in the upper surface 1*a* of the stay member correspondingly to one longitudinal side edge of the insulating substrate so that a portion of the one longitudinal side edge faces the recess portion 6, so that the insulating substrate can crack by a heat accumulation effect in this portion facing the recess portion.

5 Claims, 5 Drawing Sheets

LINE-TYPE HEATER

BACKGROUND OF THE INVENTION

1. Field of the Invention

The present invention relates to a line-type heater used as a heating source or the like in a toner fixing portion of a copying machine or an electrophotographic printer.

2. Description of the Related Art

Conventionally, such a line-type heater is generally well known. For example, as disclosed in JP-A-7-147180, a line-type heater has such a configuration that a heating resistance film is formed on the surface of an insulating substrate which is formed from a ceramic material and formed into a long strip so that the heating resistance film extends in a line in the longitudinal direction of the insulating substrate. The insulating substrate is attached to a stay member so that the back of the insulating substrate is in tight contact with the surface of the stay member. Thus, the heating resistance film can heat all over its length when a current is supplied to the heating resistance film on the surface of the insulating substrate from the both sides of the heating resistance film.

In addition, conventionally, to manufacture the line-type heater, such a method has been adopted as follows. That is, a raw substrate made from ceramic material and formed by putting a plurality of sheets of long strip-like insulating substrates side by side and integrating them with each other is formed. A heating resistance film is formed on the surface of this raw substrate at places corresponding to the respective insulating substrates, and then the raw surface is broken into pieces corresponding to the insulating substrates.

However, in such a line-type heater, it cannot be expected to generate a crack when the temperature of the heating resistance film becomes abnormally high temperature. Therefore, there is a fear that a more abnormally high temperature may be caused.

Therefore, conventionally, at least one small-diameter through hole is formed in the insulating substrate at a portion on its longitudinally way, so that the insulating substrate can crack at the portion of the through hole in case of abnormal temperature to thereby prevent the temperature from increasing more.

However, when at least one small-diameter through hole is formed in an insulating substrate at a portion on its longitudinal way so that the insulating substrate can crack at the portion of the through hole in case of abnormal temperature, the strength of the insulating substrate is reduced extremely in the portion where the through hole is formed because the insulating substrate is shaped in a long strip. Accordingly, there was a problem that when the insulating substrate was manufactured by breaking a raw substrate having a plurality of sheets of such insulating substrates put side by side and integrated with each other, or when the broken pieces of the insulating substrate were handled ordinarily, for example, when they carried, attached and so on, the broken pieces of insulating substrates were often snapped in their through hole portions.

There was another problem that when the insulating substrate was cracked due to abnormal temperature of its heating resistance film, the broken pieces of the heating resistance film contacted with and separated from each other repeatedly in their broken surfaces so as to generate sparks in those portions.

SUMMARY OF THE INVENTION

It is a first technical object of the present invention to provide a structure of a line-type heater in which the former problem can be solved. It is a second technical object to provide a structure in which the latter problem as well as the former problem can be solved.

A first aspect of device is a line-type heater of the present invention, which comprises a stay member, a strip-like insulating substrate disposed on said stay member so that a back of said insulating substrate is in tight contact with a surface of said stay member, and a heating resistance member formed on a surface of said insulating substrate so as to extent in a line in the longitudinal direction of said insulating substrate, wherein a recess portion is provided in a portion in the surface of said stay member corresponding to one longitudinal side edge of said insulating substrate so that a portion of said one longitudinal side edge faces said recess portion.

A second aspect of the device is a line-type heater according to the first aspect, wherein the stay member comprises the recess portion at each of positions corresponding to both longitudinal side edges of said insulating substrate.

A third aspect of the device is a line-type heater according to the second aspect, wherein the recesses are deposed on the opposite side of the longitudinal side edge of said insulating substrate so as to face each other.

A fourth aspect of the device is a line-type heater according to the second aspect, wherein the recesses are deposed on the opposite side of the longitudinal side edge of said insulating substrate so as to deviate each other.

A fifth aspect of the device is a line-type heater according to the first aspect, wherein the surface of said stay member is formed to be curved so as to project toward said insulating substrate, while said insulating substrate is transformed and bent along the curve of the surface of said stay member, and fixedly attached to said stay member at least in both longitudinal end portions of said stay member.

Generally, in a line-type heater constituted by a stay member, a long strip-like insulating substrate disposed on the stay member so that a back of the insulating substrate is in tight contact with a surface of the stay member, and a heating resistance member formed on a surface of the insulating substrate so as to extend in a line in the longitudinal direction of the insulating substrate, a part of heat generated in the heating resistance element is transmitted to the stay member through the insulating substrate, and thereafter radiated into the atmosphere.

Therefore, as mentioned above, a recess portion is provided in a portion in the surface of the stay member correspondingly to one longitudinal side edge of the insulating substrate so that a part of the one longitudinal side edge faces the recess portion, so that the transmission of heat to the stay member is blocked in the portion of the one longitudinal side edge of the insulating substrate facing the recess portion provided in the surface of the stay member, so that a heat accumulation effect is provided in the portion.

This heat accumulation effect becomes conspicuous when the temperature of the heating resistance member becomes abnormally high, so that a difference in thermal expansion between the portion where the heat accumulation is produced and other portion increases in the insulating substrate. As a result, the insulating substrate cracks at places corresponding to the recess portion surely.

Particularly, if such recess portions are provided in portions respectively corresponding to the longitudinally left and right side edges of the insulating substrate, it is possible to improve the reliability in that the insulating substrate cracks at places corresponding to these recess portions.

Therefore, according to the present invention, it is possible to crack the insulating substrate accurately in case of abnormally high temperature without forming any through hole in the insulating substrate. Accordingly, there is an effect that it is possible to greatly reduce such a probability that the insulating substrate is snapped when the insulating substrate is manufactured by breaking a raw substrate, or when the respective insulating substrate is handled, for example, carried, attached and so on.

In addition to the above-mentioned configuration, such a configuration is provided that the surface of the stay member is formed to be curved to project toward the insulating substrate, while the insulating substrate is transformed to be bent along the curved surface of the stay member, and fixed to the stay member at least at the longitudinal opposite end portions of the stay member. As a result, when the insulating substrate cracks in case of abnormally high temperature, the two pieces of the insulating substrate can be restored in a straight line by their own elasticity with their one-end portions being fixed to the stay member, so that their broken surfaces stand out of the surface of the stay member and separate from each other. Accordingly, it is possible to surely prevent sparks from being generated on these broken surfaces.

DESCRIPTION OF PREFERABLE EMBODIMENTS

Figure 1:
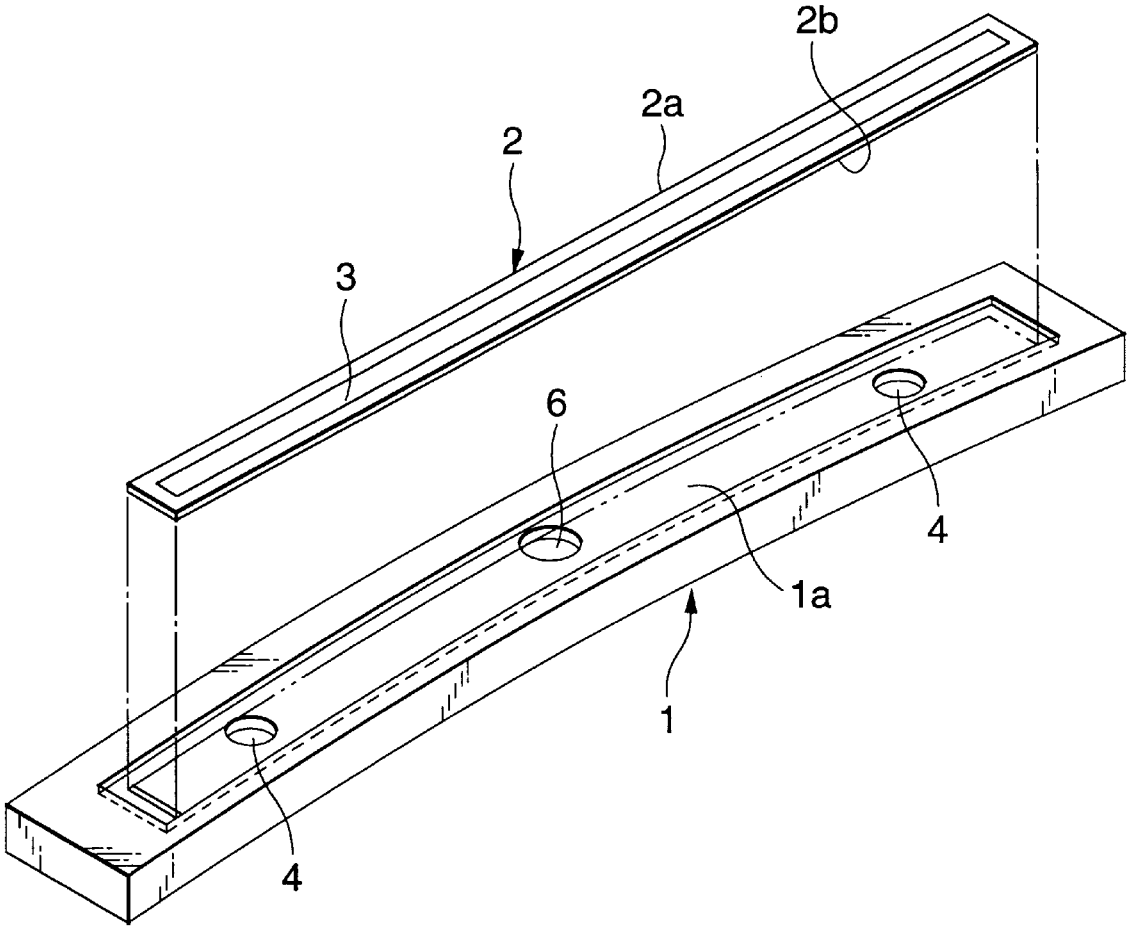
FIG. 1 is an exploded perspective view showing a first embodiment of the present invention.
Figure 2:
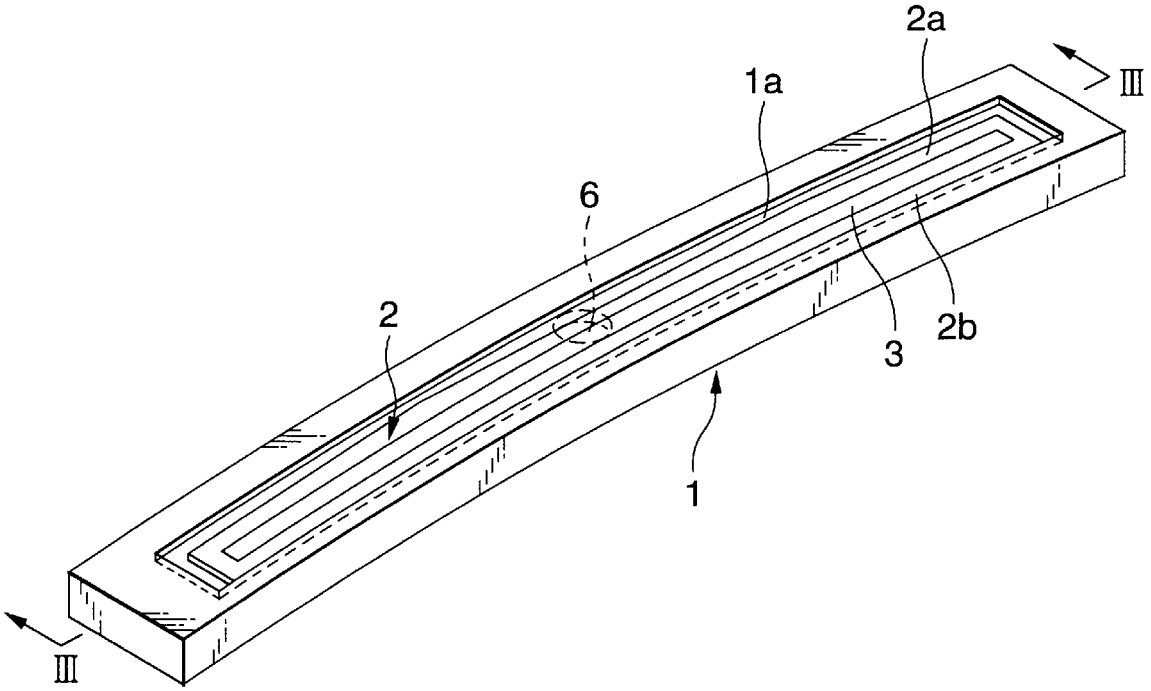
FIG. 2 is a perspective view showing the first embodiment.
Figure 3:
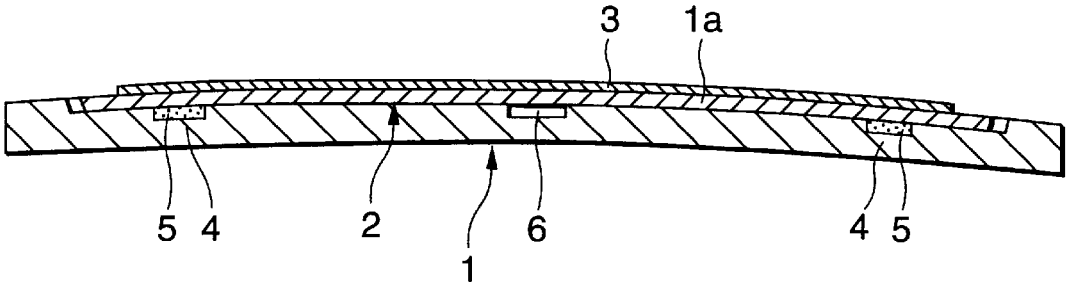
FIG. 3 is an enlarged sectional view taken on line III—III in FIG. 2.
Figure 4:
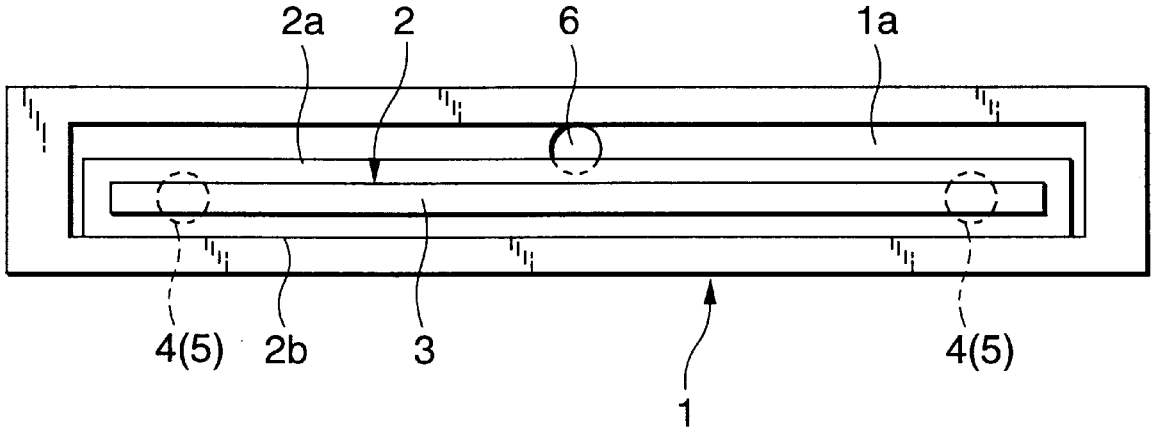
FIG. 4 is a plan view of FIG. 2.
Figure 5:
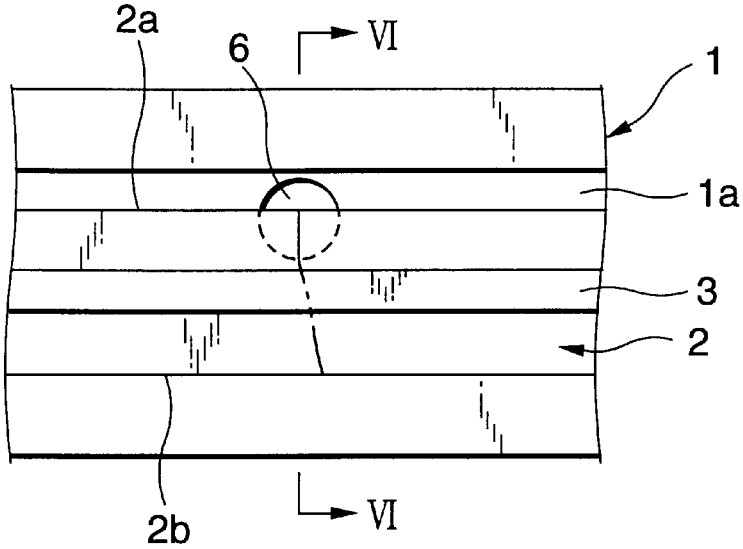
FIG. 5 is a main-portion enlarged view of FIG. 4.
Figure 6:
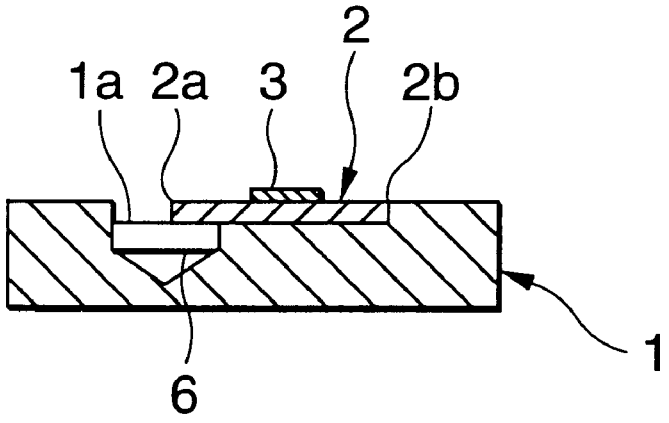
FIG. 6 is a sectional view taken on line VI—VI in FIG. 5.

An embodiment of the present invention will be described with reference to the drawings.

FIGS. 1 through 6 show a structure of line-type heater of the first embodiment of the present invention.

In the first embodiment, a stay member 1 made of heat-resistant synthetic resin on the surface of which an insulating substrate 2 made of ceramic material and shaped in a long strip is mounted, has a recess 6. And further heating resistance film 3 is formed on the upper surface of the insulating substrate 2 so as to extend in a line in the longitudinal direction of the insulating substrate 2. The recess 6 is formed at a place on which one side edge of the insulating substrate 2 is located.

To attach the insulating substrate 2 to the stay member 1 so that the whole lower surface of the insulating substrate 2 is in tight contact with an upper surface 1*a* of the stay member 1, mounting steps is as follows.

That is, the upper surface 1*a* of the stay member 1 is formed to be curved so as to project toward the insulating substrate 2, while the insulating substrate 2 is transformed against its own elasticity so as to be bent along the curve of the upper surface 1*a* of the stay member 1. Thereafter, the both end portions at least in the longitudinal direction of the insulating substrate 2 are fixedly bonded to the stay member by a bonding agent.

The reference numeral 4 represent a depressed portion provided in each of the both end portions of the upper surface 1*a* of the stay member 1, so that the both end portions of the insulating substrate 2 are fixedly attached to the stay member 1 by a bonding agent 5 filled in these depressed portions 4.

In addition, the configuration is made such that a recess portion 6 is provided in the upper surface 1*a* of the stay member 1 so that a substantially longitudinal center on one of its longitudinal side edges 2*a* of the insulating substrate 2 faces the recess portion 6.

With such a configuration, a part of heat generated in the heating resistance element 3 is transmitted to the stay member 1 through the insulating substrate 2, and thereafter radiated into the atmosphere.

However, the recess portion 6 is provided in the upper surface 1*a* of the stay member 1 so that a portion of the one longitudinal side edge 2*a* of the insulating substrate 2 faces the recess portion 6, and therefore the transmission of heat to the stay member 1 is blocked in this portion which is on the one longitudinal side edge 2*a* of the insulating substrate 2 and which faces the recess portion 6 provided in the upper surface 1*a* of the stay member 1. As a result, a heat accumulation effect is caused in this portion.

This heat accumulation effect becomes conspicuous when the temperature of the heating resistance film 3 becomes abnormally high, so that a difference in thermal expansion between the portion where the heat accumulation is produced and the other portion increases in the insulating substrate 2. As a result, the insulating substrate 2 cracks at a place corresponding to the recess portion 6 surely, as shown by the two-dot chain line in FIG. 5.

In addition, the surface of the stay member is formed to be curved so as to project toward the insulating substrate. And the insulating substrate is transformed and bent along the curve of the surface of the stay member, and fixed to the stay member at the both end portions of the insulating substrate at least in its longitudinal direction. With this configuration, when the insulating substrate 2 cracks at the place corresponding to the recess portion 6 owing to abnormally high temperature, the two pieces of the insulating substrate 2 can be restored in a straight line by their own elasticity with their one-end portions being fixed to the stay member 1 by the bonding agent 5, so that their surfaces of the broken sections stand out of the upper surface 1*a* of the stay member 1 and separate from each other. Accordingly, there is no case where any sparks appear in the surfaces of these broken sections.

The place where the recess portion 6 is provided is not limited to the portion corresponding to one longitudinal side edge 2*a* of the insulating substrate 2. Such a configuration may be made that recess portions 6 are provided in portions corresponding to both the longitudinal right and left side edges 2*a* and 2*b* of the insulating substrate 2. With this configuration, it is possible to improve the reliability that the insulating substrate 2 can crack at the places respectively corresponding to these recess portions 6 when the temperature of the heating resistance film 3 becomes abnormally high.

Figure 7:
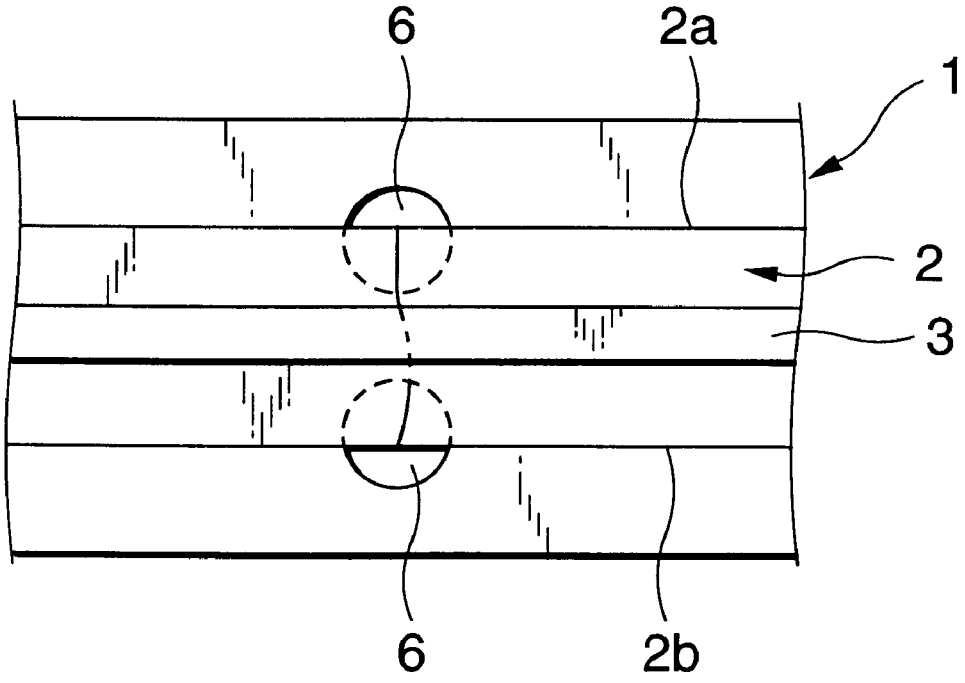
FIG. 7 is a main-portion enlarged plan view showing a second embodiment of the present invention.
Figure 8:
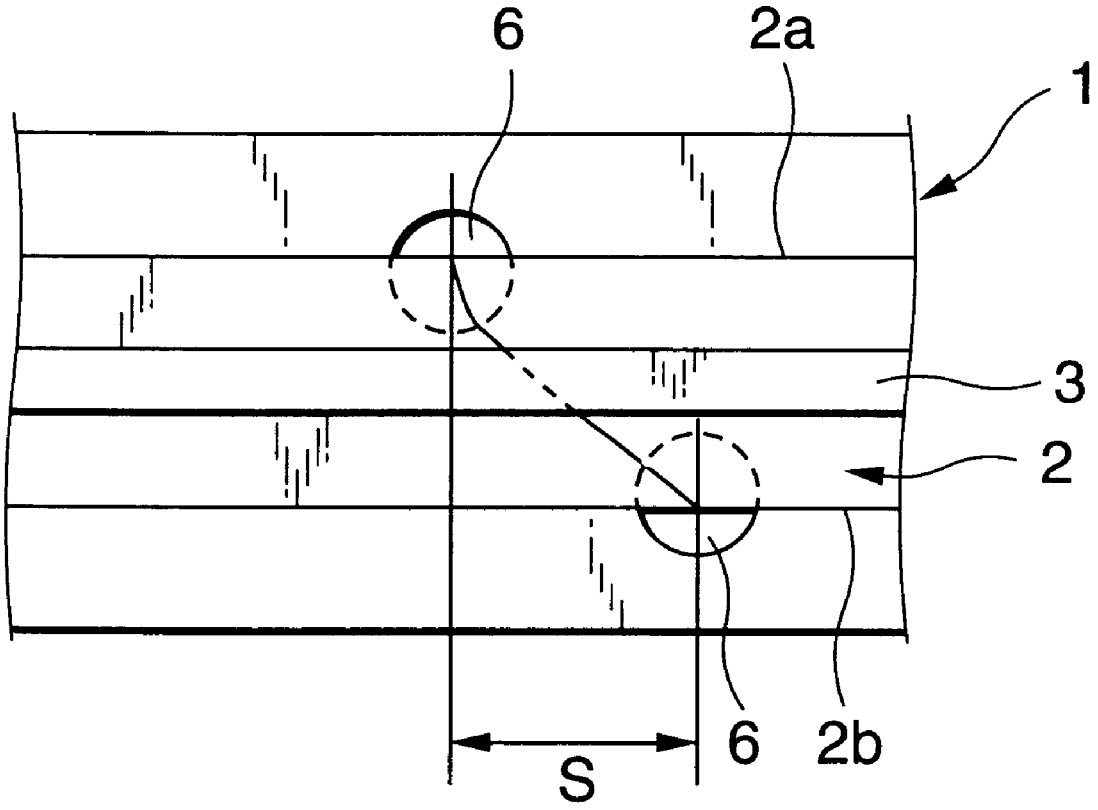
FIG. 8 is a main-portion enlarged plan view showing a modification of the second embodiment of the present invention.

When the recess portions 6 are thus provided in the portions respectively corresponding to the both of the longitudinal left and right side edges 2*a* and 2*b* of the insulating substrate 2, such a configuration may be made that these recess portions 6 are shifted from each other by a desired distance S in the longitudinal direction of the insulating substrate 2, as shown in FIG. 8 which is a modification of FIG. 7.

What is claimed is:

1. A line-type heater comprising:

a stay member;

a strip-like insulating substrate disposed on said stay member so that a back of said insulating substrate is in tight contact with a surface of said stay member; and a heating resistance member formed on a surface of said insulating substrate so as to extend in a line in a longitudinal direction of said insulating substrate; wherein a first recess portion is provided in a portion in the surface of said stay member corresponding to a first longitudinal side edge of said insulating substrate so that a portion of said first longitudinal side edge faces said first recess portion, said first longitudinal side edge being in tight contact with said stay member except at said first recess portion, wherein said insulating substrate cracks at said first recess portion when the temperature of said heating resistance member becomes abnormally high.

2. The line-type heater according to claim 1, wherein a second recess portion is provided in a portion in the surface of said stay member corresponding to a second longitudinal side edge of said insulating substrate so that a portion of said second longitudinal side edge faces said second recess portion, said second longitudinal side edge being in tight contact with said stay member except at said second recess portion, wherein said insulating substrate cracks at said second recess portion when the temperature of said heating resistance member become abnormally high.

3. The line-type heater according to claim 2, wherein said first recess portion and said second recess portion are laterally deposed on opposite sides of said insulating substrate so as to face each other.

4. The line-type heater according to claim 2, wherein said first recess portion and said second recess portion are laterally deposed on opposite sides of said insulating substrate so as to be displaced relative to each other in the longitudinal direction of said insulating substrate.

5. The line-type heater according to claim 1, wherein said stay member has two end portions and a surface between the two end portions of said stay member which is formed to be curved so as to project toward said insulating substrate, while said insulating substrate is elastically transformed and bent along the curve of the surface of said stay member, and fixedly attached to said stay member at least at each of the two end portions of said stay member, such that if said insulating substrate cracks into two pieces, each of the two pieces of said insulating substrate return to a substantially straight shape.

* * * * *